US006183306B1

(12) United States Patent
Caveney

(10) Patent No.: US 6,183,306 B1
(45) Date of Patent: Feb. 6, 2001

(54) STAGGERED INTERFACE CONTACTS

(75) Inventor: Jack E. Caveney, Hinsdale, IL (US)

(73) Assignee: Panduit Corp., Tinley Park, IL (US)

( * ) Notice: Under 35 U.S.C. 154(b), the term of this patent shall be extended for 0 days.

(21) Appl. No.: 09/197,897

(22) Filed: Nov. 23, 1998

Related U.S. Application Data

(60) Provisional application No. 60/066,728, filed on Nov. 21, 1997.

(51) Int. Cl.[7] ..... H01R 24/00
(52) U.S. Cl. ..... 439/676; 439/941
(58) Field of Search ..... 439/676, 941

(56) References Cited

U.S. PATENT DOCUMENTS

| | | | |
|---|---|---|---|
| 4,274,691 | 6/1981 | Abernethy et al. | 439/676 |
| 4,648,678 | 3/1987 | Archer | 439/676 |
| 5,061,209 | 10/1991 | Bolick, Jr. et al. | 439/676 |
| 5,399,107 | 3/1995 | Gentry et al. | 439/676 |
| 5,599,209 | 2/1997 | Belopolsky | 439/676 |
| 5,639,266 | 6/1997 | Patel | 439/676 |
| 5,674,093 | 10/1997 | Vaden | 439/676 |

FOREIGN PATENT DOCUMENTS

WO 95/19056 7/1995 (WO) .

*Primary Examiner*—Neil Abrams
*Assistant Examiner*—Javaid Nasri
(74) *Attorney, Agent, or Firm*—Robert A. McCann

(57) ABSTRACT

An electrical connector which has a housing for receiving a plurality of elongated contacts, adapted to receive electrical signals. The plurality of contacts includes first and second contacts, which are adjacent to each other. The first contact having a first bend which defines the end of lower section, a second bend which defines the end of a plug contact section, and a substantially horizontally disposed end section. Furthermore, the second contact has a first bend which defines an end of the lower section, a second bend which defines an end of the vertical riser section, a third bend which defines the end of the inclined section, and a plug contact area associated with the free end.

5 Claims, 4 Drawing Sheets

STAGGERED INTERFACE CONTACTS

This application claims the benefit of U.S. Provisional Application Ser. No. 60/066,728, filed Nov. 21, 1997.

TECHNICAL FIELD

The present invention relates to reducing electrical signal interference in modular electrical connectors which have closely spaced contacts. More particularly, the present invention relates to the reduction of near-end crosstalk between closely spaced contacts in modular jacks via unique contact shape and configuration.

BACKGROUND OF THE INVENTION

The Telecommunications Industry Association (TIA) in cooperation with the Electronic Industries Association (EIA) developed a proposed standard for Category 5 components, wherein the transmission requirements of such components are characterized up to 100 MHZ and are typically intended for energizing applications with transmission rates up to 100 Mbps. Furthermore, the Federal Communications Commission (FCC) adopted certain architectural standards with respect to electrical connectors utilized in the telecommunications industry so as to provide standard intermatability. The connectors that are most commonly utilized are FCC type modular plugs and jacks. The plug is commonly terminated to a plurality of wires which may be connected to a telephone handset or other communication device. The corresponding jack is commonly mounted to a panel or printed circuit board which in turn is connected to a telecommunication network.

Two important test parameters for high performance data transmission, i.e., Category 5, are Attenuation and Near-End Cross-Talk (NEXT) Loss. Near-end crosstalk loss may be defined as a measure of signal coupling from one circuit to another within a connector and it is derived from swept frequency voltage measurements on short lengths of 100-ohm twisted pair wire test leads terminated to the connector under text. NEXT loss is the way of describing the effects of signal coupling causing portions of the signal on one pair to appear on another pair as unwanted noise.

There have been numerous modular jacks meeting FCC architectural standards which have been proposed to reduce crosstalk within a modular jack. One of the latest is U.S. Pat. No. 5,674,093 to Vaden, which is incorporated herein by reference. While the approaches forwarded by Vaden and others to reduce crosstalk have significantly reduced signal coupling, and have met with some commercial success, there remains a need to further reduce the capacitance and mutual inductance between the pairs, thereby enhancing the performance of standardized modular connectors as frequencies increase, while still reducing costs and increasing reliability and ease of manufacture.

SUMMARY OF THE INVENTION

The present invention is an electrical connector primarily used in the telecommunications or data transfer fields and which exceeds the current industry NEXT standards.

This new, unique contact design minimizes the crosstalk loss in the plug/jack interface area of the jack by minimizing the amount of parallel run between adjacent contacts. Additionally, the bend points of adjacent contacts are offset to further minimize the amount of parallel run between adjacent contacts.

It is therefore an object of the present invention to provide an improved electrical jack connector which mates with standardized FCC modular plugs.

It is further object of this invention to provide a low crosstalk electrical signal transmission system.

It is a still further object of this invention to provide an electrical connector which is designed to reduce crosstalk between signal pairs.

It is another further object of this invention to provide a reduced crosstalk electrical connector where the resiliency of the contacts are not compromised.

The invention, in an illustrated embodiment thereof, has a housing for receiving a plurality of elongated contacts, which are adapted to receive electrical signals. The plurality of contacts includes first and second contacts, which are adjacent each other. The first contact has a first bend which defines the end of lower section, a second bend which defines the end of a plug contact section, and a substantially horizontally disposed end section. Furthermore, the second contact has a first bend which defines an end of the lower section, a second bend which defines an end of the vertical riser section, a third bend which defines the end of the inclined section, and a plug contact area associated with the free end.

Preferably, all of the bends in each contact are generally associated with some degree of clockwise inclination. It is also preferred that the plug contact sections remain parallel only so long as to promote adequate plug contact and considerable reduction in near-end crosstalk.

DESCRIPTION OF THE PREFERRED EMBODIMENT

Figure 1:
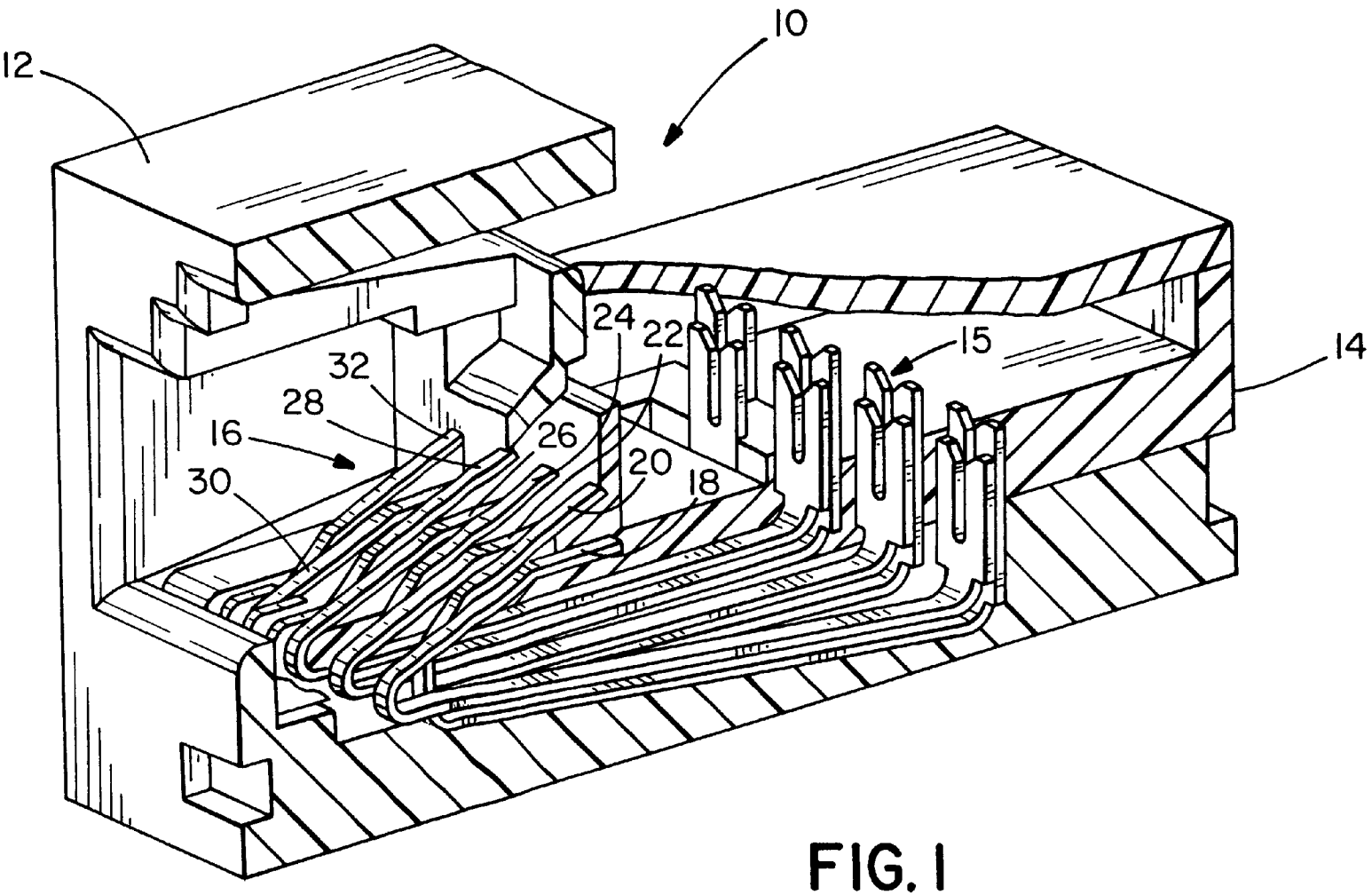
FIG. 1 is a partially cut away perspective view of the electrical connector of the present invention.

A modular jack 10 embodying the concept of the present invention is generally disclosed in the accompanying drawings. As shown in the perspective view of FIG. 1, there is provided FCC-type modular jack 10 including a housing 12 and a contact carrier 14. In this embodiment, eight spring contacts 16 are mounted on the contact carrier 14. It is preferred that the contacts 16 be made of copper alloy, bronze alloy or any other material similar thereto which is compatible for telecommunications or electronics use. Disposed at a distal end of each of the contacts 16, in this embodiment, are individually corresponding displacement contacts (IDC) 15.

Figure 2:
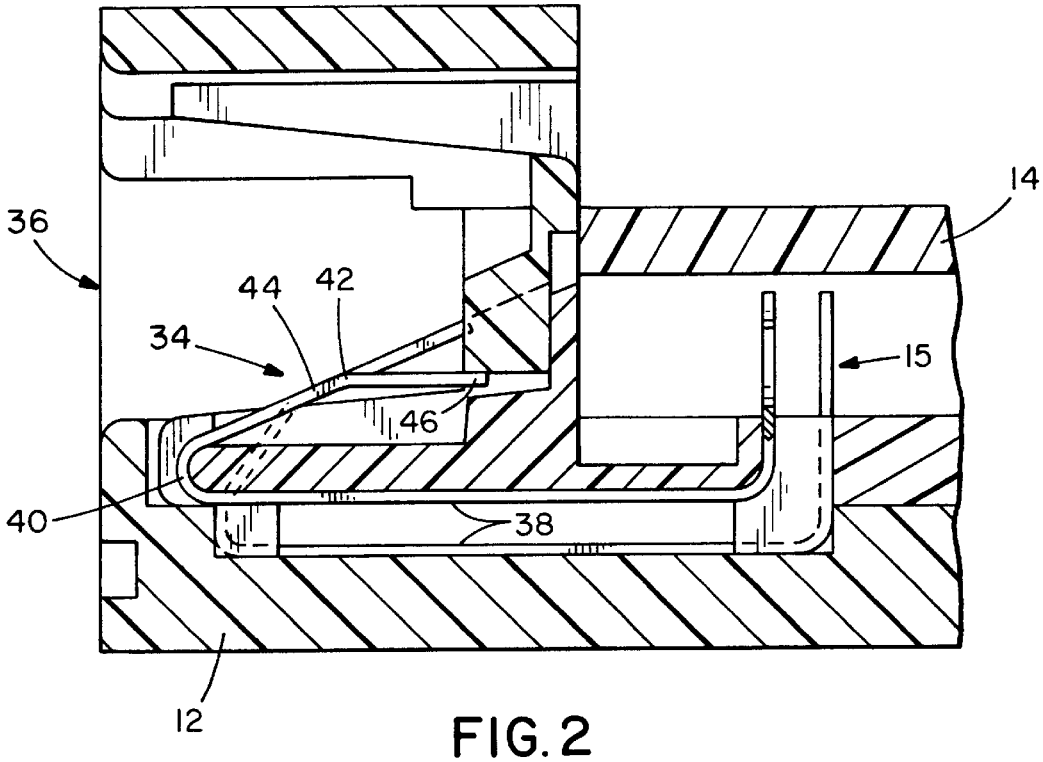
FIGS. 2 and 3 are sectional views of a first embodiment of the invention showing the first and second contact configurations, respectively.
Figure 3:
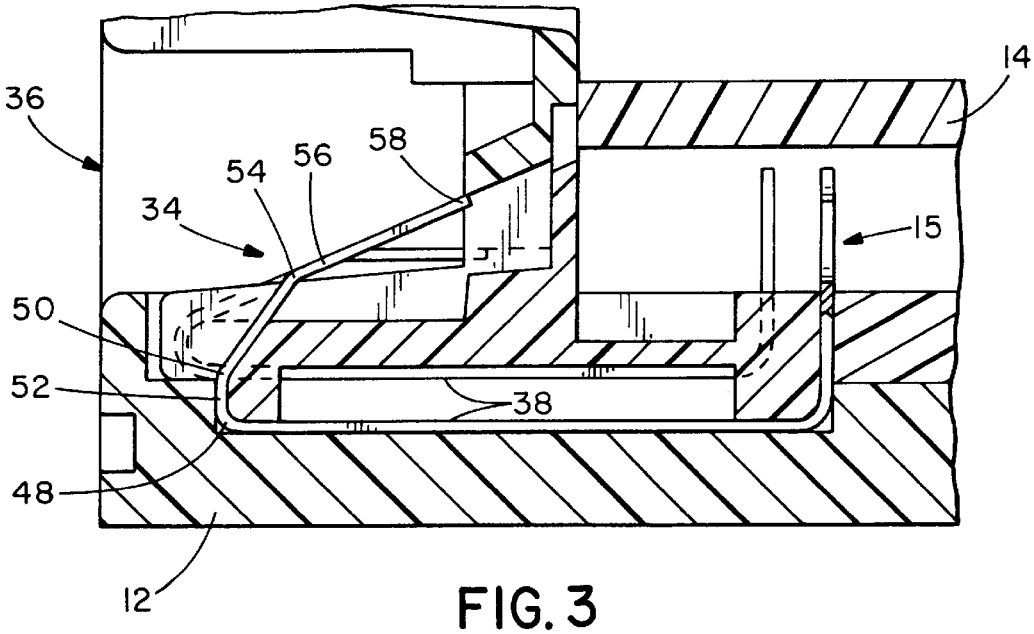

The relationship between the contact carrier 14 and the contacts 16 is better shown in reference to FIGS. 2 and 3. Contacts 18, 20, 22, 24, 26, 28, 30 and 32 are closely spaced electrical spring contacts which engage the fixed contacts in a corresponding FCC-type modular plug (not shown). Certain pairs of these contacts form parts of electrical circuits.

The contacts 16 include deflectable upper portions 34, which provide forces on the corresponding contacts in the plug when the plug is inserted into the opening 36 of the housing 12. The contacts 16 also include lower substantially fixed portions 38, and insulation displacement contacts (IDC) 15 or printed circuit board (PCB) pin-type contacts 59. The lower fixed portions 38 of the contacts 16 are laterally spaced and held in the contact carrier 14 at alternating upper and lower positions, such that one-half of the contacts 18, 22, 26 and 30 are disposed in an upper row, while the other half of the contacts 20, 24, 28 and 32 are disposed in a lower row. Furthermore, the contacts 16 include alternating adjacent contacts made of two different designs in the deflectable upper portions 34 thereof.

As shown in FIG. 2, the group of contacts 18, 22, 26 and 30 disposed in the upper row have a certain specific configuration, while the group of contacts 20, 24, 28, and 32 disposed in the lower row have a different specific configuration. The contacts 18, 22, 26 and 30 disposed in the upper row, which are all identical to the one shown, are characterized by the two bend points. At the initial bend point 40, the horizontally disposed fixed lower portion 38 of the contact reversely bends back upon itself creating a small angle with the horizontal fixed portion 38. A plug contact area 44 is defined on this upper portion 34 of the contact between the first and second bend points 40 and 42. The group of contacts is further characterized by a second bend point 42 which defines the free end portion 46 of the contact, where the contact now extends substantially horizontal.

As shown in FIG. 3, the group of contacts 20, 24, 28 and 32 disposed in the lower row, which are all identical to the one clearly shown, are characterized by three bend points. At the initial bend point 48, the horizontally disposed fixed lower portion 38 of the contact transitions vertically upward creating a small riser section 52 of the contact. The second bend point 50, which is disposed at the end of the substantially vertical section 52, redirects the contact upwardly at an angle toward the starting point of the plug contact area 56. The third bend point 54 occurs where this group of contacts, when viewed from the side as in FIGS. 2 and 3, intersects the group of contacts 18, 22, 26 and 30, thus defining the beginning of the plug contact area 56. Again, all of the contacts in the modular jack are substantially parallel in the plug contact area for this brief moment. After the plug contact area, this group of contacts continues upwardly at an angle in the same direction to a free end portion 58.

By minimizing the amount of parallel run between adjacent contacts, both capacitance and mutual inductance between the pairs are reduced. Thus NEXT is substantially reduced and performance is enhanced.

Figure 4:
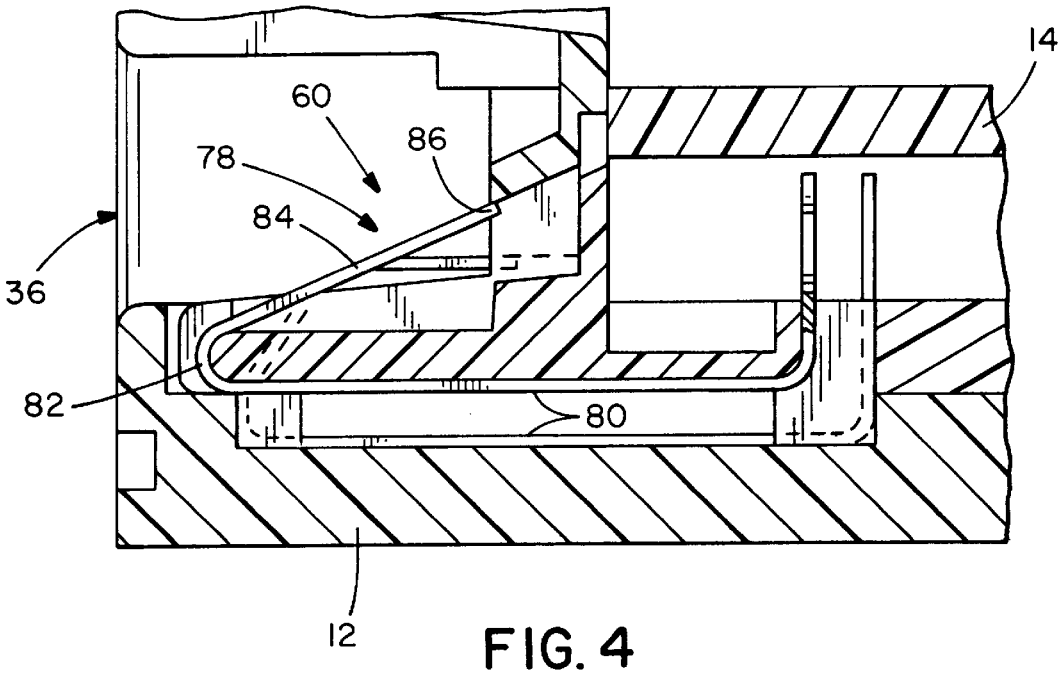
FIGS. 4 and 5 are sectional views of a second embodiment of the invention showing the first and second contact configurations, respectively.
Figure 5:
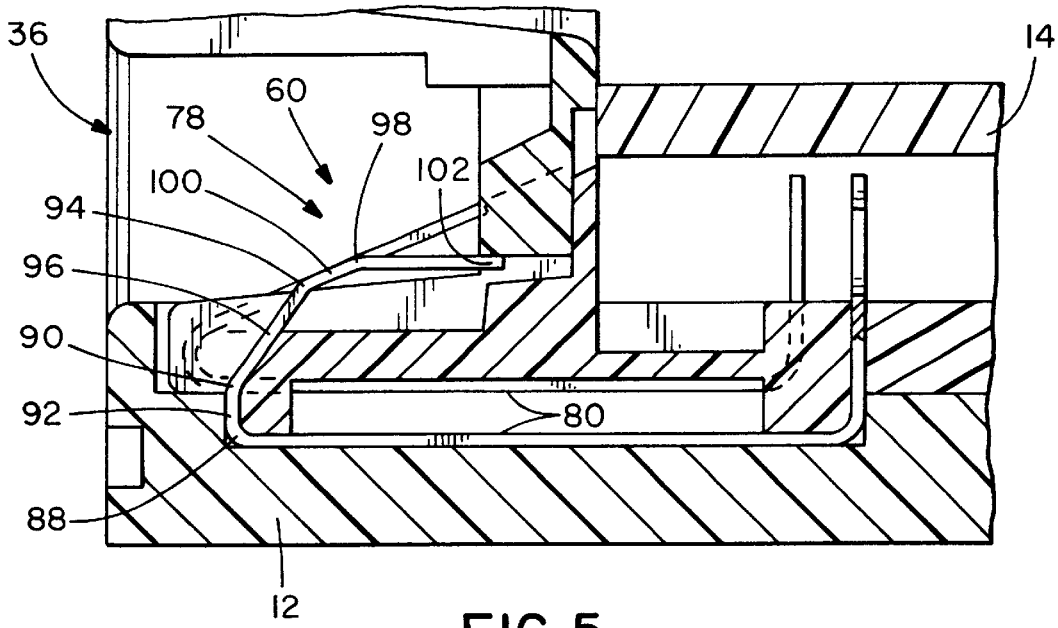

An alternative embodiment of contact configuration which produces the same results stated above is shown in FIGS. 4 and 5. Again, the contacts 60 are arranged and disposed in two separate rows as discussed above, with each row having contacts which are all identical. The contacts 60 include deflectable upper portions 78 and substantially fixed lower portions 80, disposed and arranged as discussed above. As shown in FIG. 4, the contacts 62, 66, 70 and 74 are disposed in the upper row characterized by a single bend point 82. At the initial bend point 82, the horizontally disposed fixed lower portion 80 of the contact reversely bends back upon itself creating a small angle with the horizontal fixed portion 80 of the contact. A plug contact area 84 is defined on this upper portion 78 of the contact subsequent to the first bend point 82. A free end portion 86 is disposed at a distal end of each contact. The contact configuration resembles a standard contact commonly found in lower performance modular jacks.

As show in FIG. 5, the group of contacts 64, 68, 72 and 76 disposed in the lower row, which are all identical to the one shown, are characterized by four bend points. At the initial bend point 88, the horizontally disposed fixed lower portion 80 of the contact transitions upwardly, creating a small substantially vertical riser section 92 of the contact. The second bend point 90, disposed at the end of the substantially vertical section 92, redirects the contact toward the beginning point of the plug contact area 100 via a short inclined portion 96. The third bend point 94 then transitions this group of contacts parallel with the other group of contacts for a short distance, thus defining the plug contact area 100. Again, all of the contacts of this modular plug are parallel only for this brief moment. The fourth bend point 98 defines the end of the plug contact area, where this group of contacts transitions to a substantially horizontal disposition with a free and portion 102 located at a distal end thereof.

Figure 6:
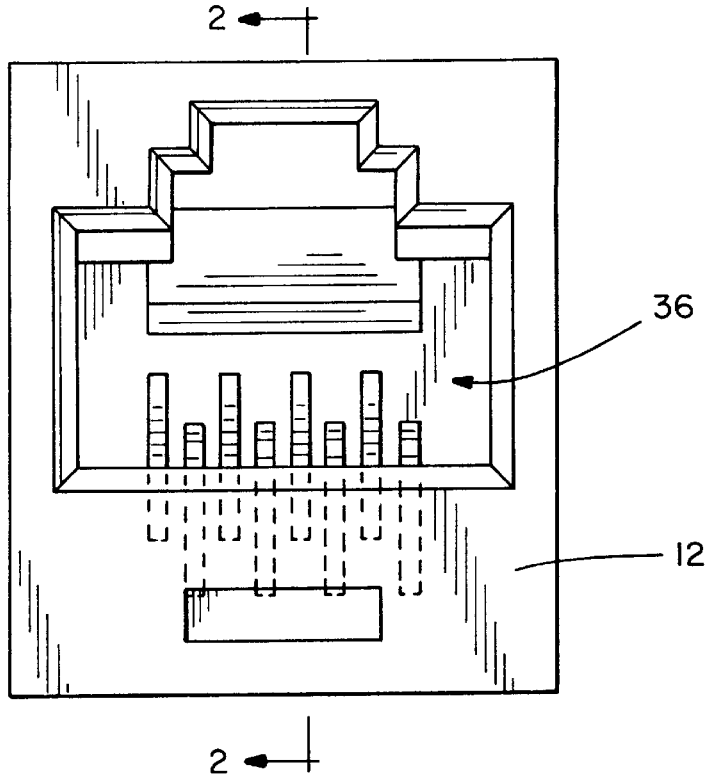
FIG. 6 is a front elevation view of the connector of FIG. 1.
Figure 7:
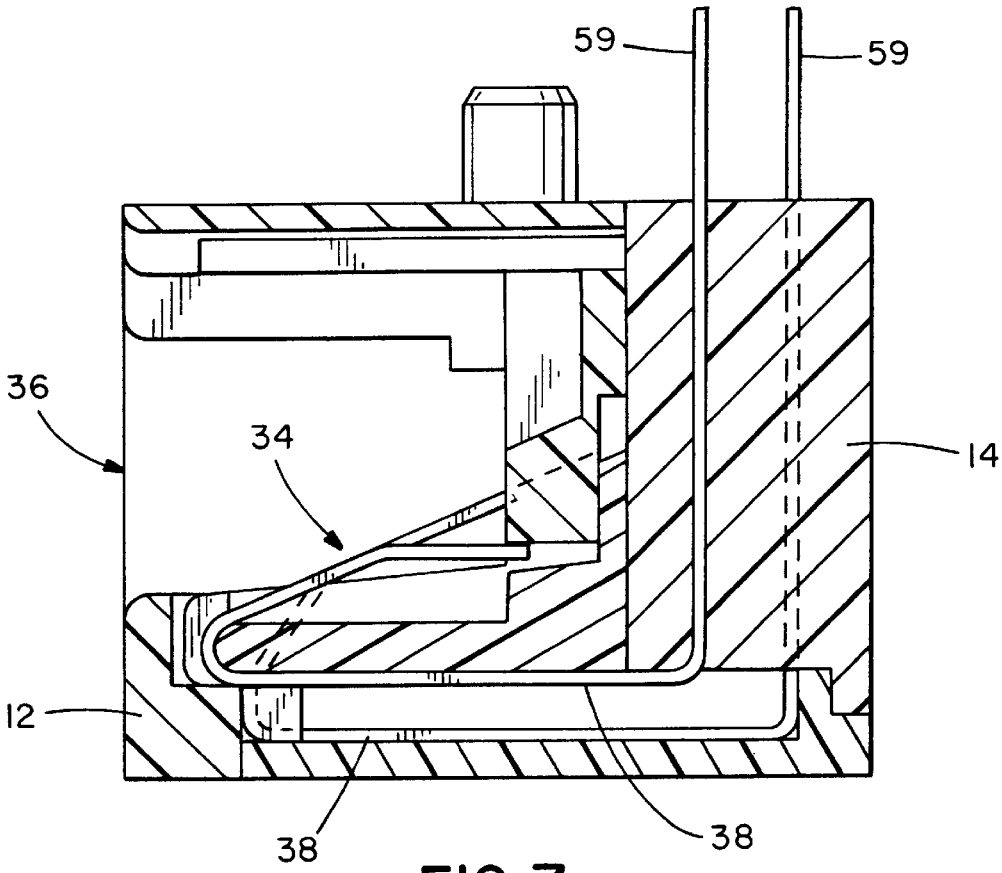
FIG. 7 is a sectional view of a third embodiment of the invention configured for connection with a printed circuit board.

FIG. 6 shows, the horizontally spaced alternating contacts are disposed in two discrete and separate rows. Either type of contact configuration described above can also be used when a modular jack 10 is required to interface with a printed circuit board (PCB). The only change in this embodiment regarding the contacts is the exchange of the IDCs 15 for straight pin-type contacts 59 for engaging the PCB, as best seen in FIG. 7.

The operation of this modular jack 10 is identical to any other FCC type jack. The plug is inserted and the circuits are closed. Telecommunications or data transfer may now take place with substantially reduced near-end crosstalk.

While the particular embodiment of the present invention has been shown and described, it will be obvious to those skilled in the art that changes and modifications may be made without departing from the invention and its broader aspects. The matter set forth in the foregoing description and accompanying drawings is offered by way of illustration only and not as a limitation.

What is claimed is:

1. An electrical connector, comprising:

a housing;

said housing receiving a plurality of elongated contacts;

said contacts adapted to receive electrical signals;

said plurality of contacts including a first contact and a second contact;

said first contact adjacent to said second contact;

said first contact having a horizontal lower portion, a first bend point defining an end of the lower portion, a plug contact area, a second bend point defining an end of the plug contact portion, and a substantially horizontally disposed end portion; and said second contact having a horizontal lower portion, a first bend point defining an end of the lower portion, a vertical riser portion, a second bend point defining an end of the vertical riser portion, and a third bend point defining a beginning of a plug contact portion.

2. The electrical connector as claimed in claim 1, wherein the plug contact areas of the first and second contacts are parallel.

3. An electrical connector comprising;

a housing;

said housing receiving a plurality of elongated contacts;

said contacts adapted to receive electrical signals;

said contacts including first and second groups;

said first group of contacts having a profile which is substantially different from the profile of said second group;

said contacts forming a row with the contacts in said first group alternating with said contacts in said second group, wherein said contacts in said first group are adjacent to said contacts in said second groups;

said first group of contacts having a first bend point defining an end of a lower portion, a second bend point defining an end of a plug contact portion, and a substantially horizontal disposed end portion; and said second group of contacts having first bend point defining an end of a lower portion, a second bend point defining an end of a vertical riser portion, and a third bend point defining a beginning of a plug contact portion.

4. An electrical connector, comprising:

a housing;

said housing receiving a plurality of elongated contacts;

said contacts adapted to receive electrical signals;

said plurality of contact including a first contact group and a second contact group;

said first contact group having a first bend point defining an end of a lower portion, and an inclined plug contact portion; and said second contact group having a first bend point defining an end of a lower portion, a second bend point defining an end of a vertical riser portion, a third bend point defining an end of an inclined portion, a fourth bend point defining an end of a plug contact portion, and a substantially horizontally disposed end portion.

5. The electrical connector as claimed in claim 4, wherein the plug contact areas of the first and second contacts are parallel.

* * * * *